US006817608B2

(12) United States Patent
Sloan, Jr. et al.

(10) Patent No.: US 6,817,608 B2
(45) Date of Patent: Nov. 16, 2004

(54) METHOD AND APPARATUS FOR STACKING MAILPIECES IN CONSECUTIVE ORDER

(75) Inventors: Richard A. Sloan, Jr., Southbury, CT (US); Paul R. Sette, Branford, CT (US); Jeffrey T. Mulreed, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 198 days.

(21) Appl. No.: 10/119,263

(22) Filed: Apr. 9, 2002

(65) Prior Publication Data

US 2003/0189283 A1 Oct. 9, 2003

(51) Int. Cl.[7] ..... B65H 31/06

(52) U.S. Cl. ..... 271/216; 271/185; 271/184; 271/202

(58) Field of Search ..... 271/184, 202, 271/216, 185, 69

(56) References Cited

U.S. PATENT DOCUMENTS 1,581,583 A * 4/1926 Low ..... 271/184
1,838,510 A * 12/1931 White ..... 271/202

(List continued on next page.)

FOREIGN PATENT DOCUMENTS

JP 62-269843 * 11/1987 ..... 271/184
WO 94-135566 * 6/1994 ..... 271/202

*Primary Examiner*—Donald P Walsh
*Assistant Examiner*—Daniel K Schlak
(74) *Attorney, Agent, or Firm*—Karin A. Russo; Charles R. Malandra, Jr.; Angelo N. Chaclas

(57) ABSTRACT

The present invention provides a method and apparatus for stacking mailpieces received from a mail-processing machine in consecutive order. There is a receiving conveying section positioned at a greater height than the following stacking conveying section. A stacking ramp extends from the downstream portion of the stacking conveying section. The receiving conveying section has a single continuous belt extending along the receiving conveying section in a first direction and positioned centrally along a second direction of the conveying section. The continuous belts of the stacking conveying section are positioned substantially at equal intervals extending along the first direction of the stacking conveying section and have top surfaces which extend above the stacking conveying section and which contact the mailpieces received from the mail processing machine. Additionally, included are means for driving the continuous belt at a first speed on the receiving conveying section in the first direction and for driving the belt at a second speed on the stacking conveying section in the same direction, the second speed of the plurality of belts is slower than the first speed of the continuous belt on the receiving conveying section. There is also a hold down means which positions and guides the mailpieces, positioned at the downstream portion of the receiving conveying section comprising normal force rollers that contact the receiving conveying belt to align the mailpieces at the receiving conveying section and guide the mailpieces onto the stacking conveying belt.

11 Claims, 6 Drawing Sheets

U.S. PATENT DOCUMENTS 2,177,460 A * 10/1939 Frenz ..... 271/199
3,658,322 A * 4/1972 Martin ..... 271/184
3,912,258 A * 10/1975 Martin ..... 271/184
3,945,635 A * 3/1976 Marin ..... 271/202
3,998,141 A * 12/1976 Hsiue ..... 414/789.1
4,099,712 A * 7/1978 Martin ..... 271/184
4,314,644 A * 2/1982 Stocker ..... 209/569
4,527,792 A * 7/1985 Burkhardt ..... 271/225
4,718,656 A * 1/1988 Reist ..... 271/3.02
4,724,945 A * 2/1988 Martin ..... 198/412
4,867,435 A * 9/1989 Cogswell et al. ..... 271/182
5,112,037 A * 5/1992 Holbrook ..... 271/2
5,137,415 A * 8/1992 Doeberl et al. ..... 414/798.5
5,180,154 A * 1/1993 Malick ..... 271/2
5,180,159 A * 1/1993 Malick ..... 271/302
5,364,090 A * 11/1994 Hollis et al. ..... 271/216
5,411,250 A 5/1995 Belec et al. ..... 271/185
5,464,317 A * 11/1995 Foster et al. ..... 414/798.2
5,503,386 A * 4/1996 Straessler et al. ..... 271/225
5,508,818 A * 4/1996 Hamma ..... 358/403
5,575,465 A * 11/1996 Auerbach et al. ..... 271/9.13
5,615,995 A 4/1997 Nobile et al. ..... 414/798.2
5,731,574 A * 3/1998 Bodie et al. ..... 235/375
5,961,114 A 10/1999 Barker et al. ..... 271/184
6,102,391 A * 8/2000 Malick et al. ..... 271/225
6,511,063 B1 * 1/2003 Dickhoff et al. ..... 271/184
6,623,002 B1 * 9/2003 Auerbach ..... 271/223

* cited by examiner

REGISTRATION ASSEMBLY

FULL ARM FIXTURE SETTING ON RAMP

METHOD AND APPARATUS FOR STACKING MAILPIECES IN CONSECUTIVE ORDER

FIELD OF THE INVENTION

The present invention relates generally to a mailpiece stacking device and method. More particularly, the invention relates to a method and apparatus for a mailpiece-stacking device that is intended for use with large volume mail handling machines in which mailpieces are discharged from an addressing printer.

BRIEF DESCRIPTION OF THE ART

Mailpiece stacking machines are well-known and have been used successfully in conjunction with various mailpiece processing machines, such as inserting machines, mailpiece printing machines, mail stamp cancellation machines, and envelope printing machines. The mailpiece is generally conveyed to a stacking device as the envelope leaves the mailpiece-processing machine. There are conventional stacking devices in which mailpieces are processed along a horizontal path after the mailpiece processing function is completed. There are also conventional stacking devices in which mailpieces are transported in a vertical orientation along a dual belt transport system on a horizontal surface.

Stacking devices in which mailpieces are processed along a horizontal path typically eject mailpieces from a mail-processing machine onto elongated conveying belts. The mail pieces are transported under a pressure wheel that assists in registering the mailpieces as they are transported toward a stacking wall. The mailpieces are lined against the stacking wall until the stack of mailpieces contacts the pressure wheel. The stack of mailpieces must then be removed from the stacking device to avoid overfilling or overflowing.

The removed stack of mailpieces is then manually placed in a mail tray that is sent to the postal service. The user can take advantage of lower postal rates that are provided to users who place mailpieces in trays according to predetermined criteria. The predetermined criteria include maintaining the mailpieces in the exact order in which they were processed in the mail processing machine. Generally, the predetermined criteria relates to a reduction in the postal service's handling of the mail from the mailers. The United States Postal Service ("USPS") offers several levels of discounts to mailers who conform to the predetermined criteria. The level of discount typically is based on the number of criteria met by the mailer. To maximize such postage discounts, the USPS requires that high volume mailers presort the mailpieces, apply a ZIP+4 bar code to each mailpiece, and package their mail into trays with each tray tagged in accordance with the Domestic Mail Manual.

To obtain the postal rate discounts, the consecutive order of the mailpieces that have been presorted and processed by the mail-processing machine needs to be maintained. There are different stacking devices that have been designed for use with mail processing machines that have different speeds and volumes of output. As an example, the method and apparatus of conventional "on-edge" stacking devices in which the lead edge of the mailpieces is urged against a fixed registration surface or a stacking wall is one way of maintaining the consecutive order of the mailpieces. The mailpieces are overlapped or shingled to maintain a consecutive order as the mailpieces are transported on the conveying belts to accumulate against the stacking wall.

A serious limitation to existing on-edge stacking devices, however, is maintaining a shingled relationship of the mailpieces as the mailpieces accumulate behind each other at the stacking wall while stacking mailpieces processed by a high-speed mail-processing device. The stacking devices have been designed to have conveying belts provide transport to the mailpieces. The conveying belts move at a slower linear speed than the speed at which the mail-processing machine is ejecting the mailpieces; therefore, oftentimes, a mail piece will be projected onto the stacking device conveying belts from the mail processing machine and overlap the previous mail piece to create a shingled relationship of the mail pieces. Due to the irregularity of the speed of the mail processing equipment, gaps between mailpieces are created. Mailpieces will get "bunched up" at the end of the conveyor instead of shingling and maintaining the consecutive order. Mailpieces are forced out of the consecutive order in which they were processed in the mail-processing machine, resulting in a lower postage discount than would otherwise be granted to the mailer.

There are other stacking devices that transport mailpieces vertically along a dual belt transport followed by various forms of stacking mechanisms normally used with high speed and high volume mail processing equipment. High volume mail processing machines typically process and eject between 5,000 and 36,000 pieces of mail per hour. The majority of these devices stack received mailpieces in a vertical orientation on a horizontal surface. Typically, in this type of system, a high speed, on-edge stacking device, mailpieces are transported vertically in a controlled manner with the conveying belts on both sides of the mailpiece, i.e., a dual belt transport system. The mailpieces typically stop against some type of vertical registration surface. Although the reliability of stacking mailpieces in consecutive order is maintained with this type of stacking device, the cost and the size of the high speed, high volume stackers having dual belt transports often cannot be justified. Also, when the mailpieces are transported vertically along a dual belt transport system, the ink that has been printed on mailpieces by printing devices may smear.

Thus, what is needed to overcome the above-mentioned drawbacks is a cost-efficient stacking device for use with high-speed mail processing machines that can reliably stack mailpieces in consecutive order without smearing the ink on the mailpieces.

SUMMARY OF THE INVENTION

The present invention provides an apparatus for stacking mailpieces received from a mail-processing machine in consecutive order. The apparatus comprises a frame, a plurality of conveying sections, the plurality of conveying sections comprising a receiving conveying section having an upstream portion and a downstream portion and a stacking conveying section having an upstream portion and a downstream portion, the receiving conveying section is positioned at a first height at a right angle to the mail processing machine at the upstream portion and in line with the stacking conveying section at the downstream portion, wherein the stacking conveying section is at a second height and the first height is greater than the second height. There is also a ramp that extends from the downstream portion of the stacking conveying section. A first continuous belt extends along the receiving conveying section in a first direction positioned centrally along a second direction of the conveying section and has a top surface that extends above the receiving conveying section and contacts the mailpieces received from the mail processing machine. A plurality of second continuous belts extends along the stacking conveying section in the first direction and is positioned substantially at equal intervals extending along the second direction of the stacking conveying section. The plurality of second continuous belts has a top surface that extends above the stacking conveying section and contacts the mailpieces received from the receiving conveying section. The apparatus for mailpiece stacking also has a means for driving the first continuous belt at a first speed on the receiving conveying section in the first direction and for driving the plurality of second continuous belts at a second speed on the stacking conveying section in the first direction with the second speed of the plurality of belts being less than the first speed of the first continuous belt on the receiving conveying section. Also, there is an assembly for positioning the mailpieces received from the mail processing machine in a first direction on the single continuous belt of the receiving conveying section in a second direction adjustably mounted to the frame at the upstream portion of the receiving conveying section, wherein the receiving conveying section is located between the assembly and the mail-processing machine. There also is a means for positioning and guiding mailpieces connected to the frame at the downstream portion of the receiving conveying section. The means for positioning the mailpieces are normal force rollers that contact the receiving conveying belt to align the mailpieces at the receiving conveying section and guide the mailpieces onto the stacking conveying belt.

An alternative embodiment is shown in which an apparatus for stacking mailpieces received from an output device in consecutive order comprises a frame, a receiving conveying section having an upstream portion and a downstream portion and a stacking conveying section having an upstream portion and a downstream portion. The receiving conveying section is positioned at a first height and adjacent to a mail processing machine at the upstream portion and orthogonal to the stacking conveying section at the downstream portion. The stacking conveying section is at a second height. The first height is greater than the second height. There is a ramp that extends from the downstream portion of the stacking conveying section. Also, a first continuous belt extends along the receiving conveying section in a first direction, is positioned centrally along a second direction of the conveying section, and has a top surface that extends above the receiving conveying section contacting the mailpieces. There is also a second continuous belt that extends along the stacking conveying section in the second direction and is positioned along the first direction of the stacking conveying section, the continuous belt having a top surface which extends above the stacking conveying section and which contacts the mailpieces received from the mail processing machine. There additionally are means for driving the continuous belt at a first speed on the receiving conveying section in the first direction and for driving the belt at a second speed on the stacking conveying section in the second direction. The second speed of the plurality of belts is slower than the first speed of the continuous belt on the receiving conveying section. There is also a hold down means at the downstream portion of the receiving conveying section for positioning and guiding the mailpieces. The hold down means comprises normal force rollers that contact the receiving conveying belt to align the mailpieces at the receiving conveying section and guide the mailpieces onto the stacking conveying belt.

Also disclosed is a method of stacking mailpieces received from a mail-processing device, wherein the mailpiece has a long leading edge, a long trailing edge, a short leading edge and a short trailing edge is also disclosed. To begin, a first mailpiece from the mail-processing device is received in a first direction with the short edge leading. The mailpiece is deflected onto the onto moving conveying belt with the long edge leading, the moving conveying belt is moving in a second direction, the second direction is at a right angle to the first direction. Then a second mailpiece is received onto the conveying belt from the mail processing device in the first direction with the short edge leading. The second mailpiece is deflected onto the moving conveying belt with the long edge leading while the conveying belt is moving in a second direction. The second direction is orthogonal to the first direction. The movement of the first mailpiece on the moving conveying belt is continued under an adjustable hold down assembly that positions and guides the mailpieces. The hold down assembly comprises a plurality of normal force rollers. The first mailpiece is moved from the receiving conveying belt traveling at a first speed and positioned at a first height to the stacking conveying belt positioned at a second speed and a second height, the first speed is faster than the second speed, the first height is higher than the second height. Then the second mailpiece is guided onto the long edge trailing of the first mailpiece. The movement of the mailpiece toward the vertically sloped stacking ramp is continued until the mailpiece interfaces with the sloped stacking ramp.

BRIEF DESCRIPTION OF THE DRAWINGS

The accompanying drawings, which are incorporated in and constitute a part of the specification, illustrate a presently preferred embodiment of the invention, and together with the general description of the preferred embodiment given below, serve to explain the principles of the invention.

DETAILED DESCRIPTION OF THE PRESENT INVENTION

The apparatus will be described, followed by a description of the apparatus in relation to the handling of envelopes or other similar pieces of mail, it being understood, however, that the instant apparatus may handle various other types of planar articles.

Figure 1:
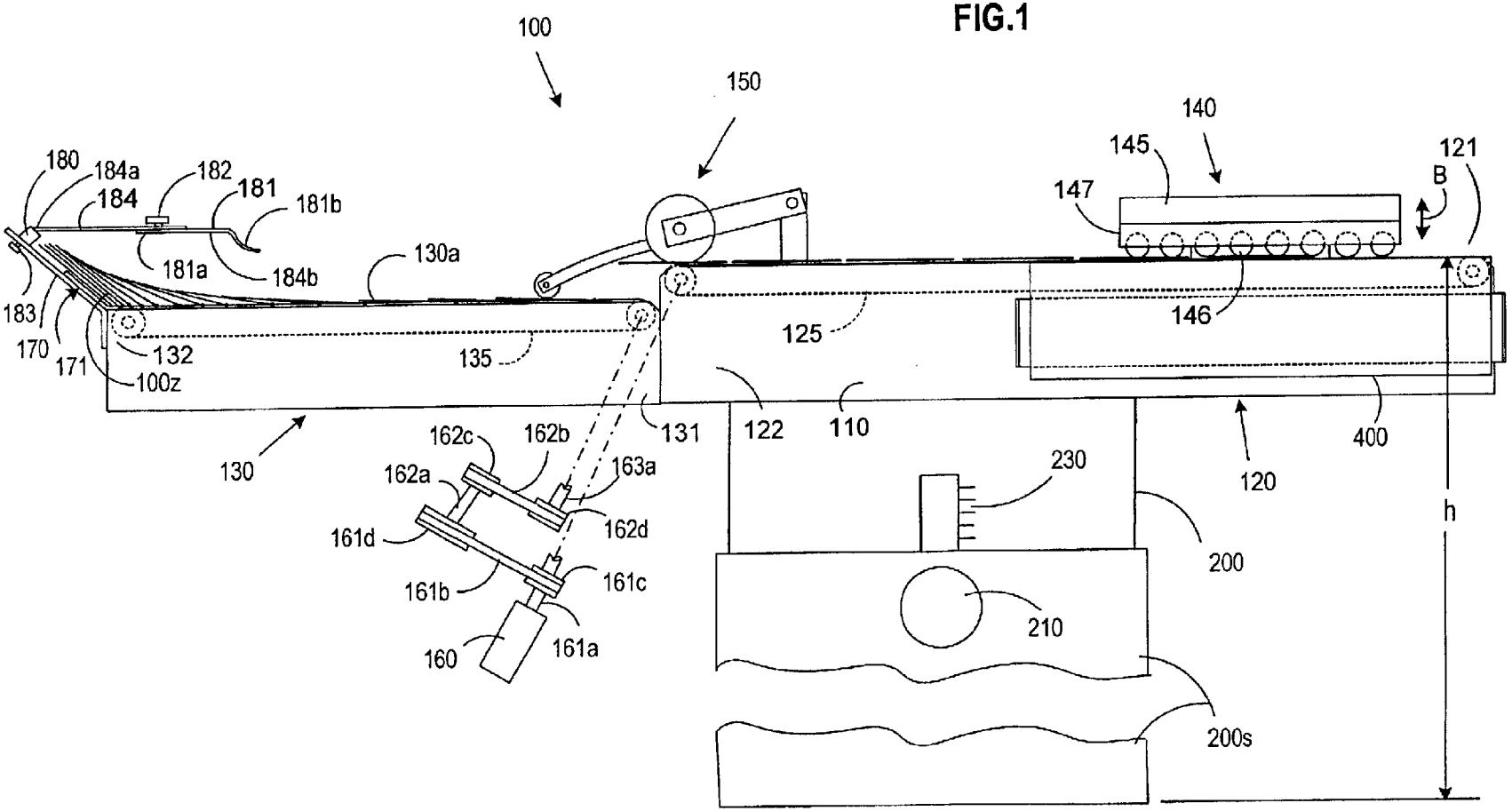
FIG. 1 is an elevation view of the present invention illustrated in the position it would occupy during use.
Figure 2:
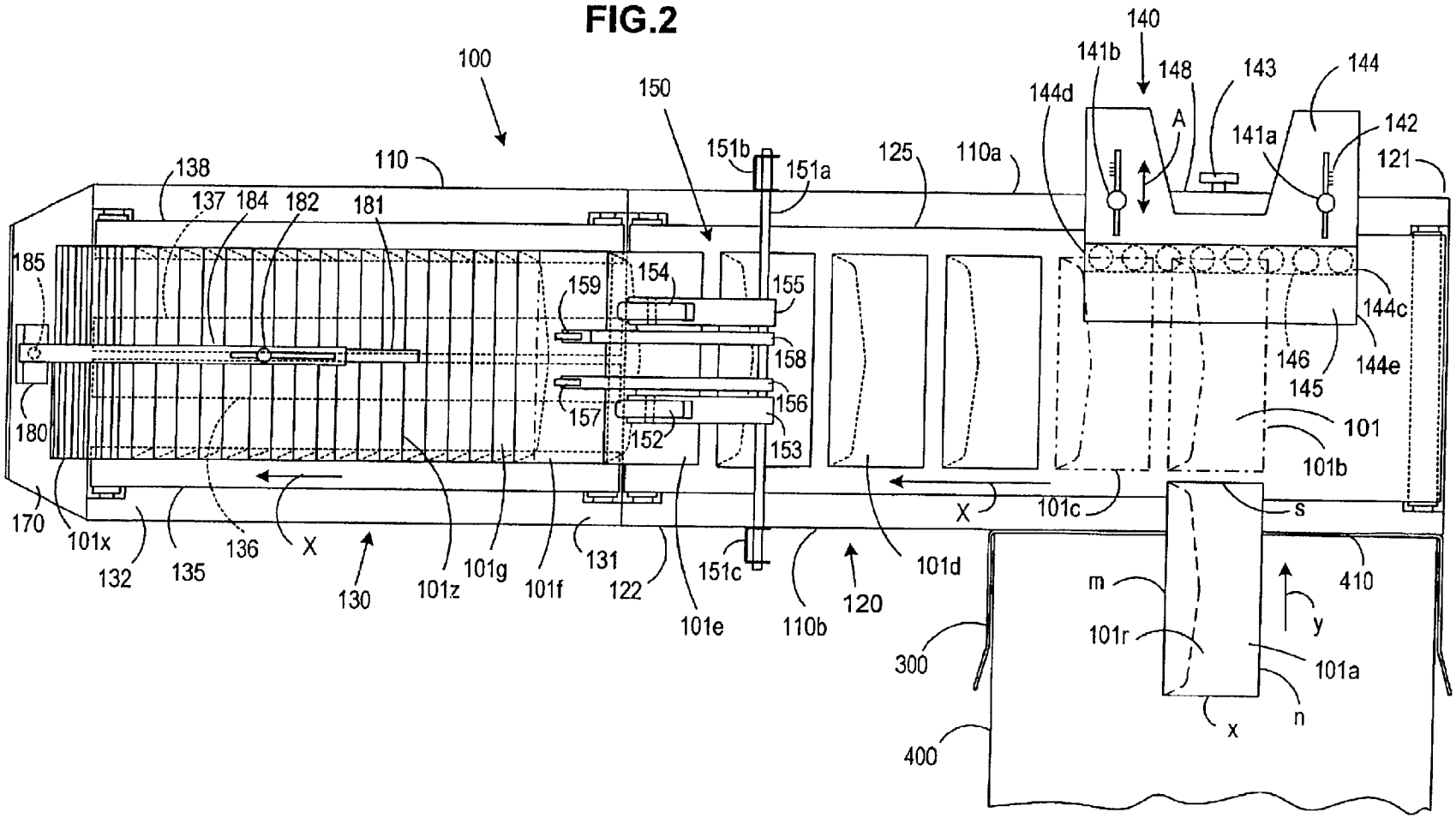
FIG. 2 is a plan view of the stacking machine showing mailpieces in various stages of transport illustrating the position it would occupy during use with an envelope printer.

In describing the preferred embodiment of the present invention, reference is made to the drawings, wherein there is shown in FIGS. 1–2, a stacking machine 100 in conjunction with a mail processing or mail-handling machine. The mail-processing machine shown in the Figures is an envelope printer 400. Although the mail-handling machine is described as envelope printer 400, any suitable mail processing or mail-handling machine could also be used. For example, an envelope printer 400 such as the Pitney Bowes W990™ Envelope Printer can be used. The stacking machine 100 comprises generally a horizontal frame 110 that supports all of the operating components of the stacking machine 100. The stacking machine 100 has two conveying sections positioned in line. The first receiving conveying section 120 has a single, wide, conveying belt 125, a motor 160 with associated driving means, a registration assembly 140 attached at the upstream portion 121, and a hold down assembly 150 attached at the downstream portion 122 of the receiving conveying section 120. The second conveying stacking section 130 has a plurality of endless stacking conveying belts 135, 136, 137, 138, and, at the downstream portion 132, an angled stacking ramp 170 with a stacker full arm fixture 180 adjustably attached thereto.

The envelope printer 400 includes an output passageway 410 through which printed mailpieces 101 exit the envelope printer 400. An adapter piece 160 aligns the printer 400 to the stacking machine 100 at the upstream portion 121 of the receiving conveying section 120. The W990 Envelope Printer prints mailpieces at speeds of between 22–75 inches per second. The adapter piece 160 connects the envelope printer 400 to the stacking device 100 so that a mailpiece 101 will exit the printer 400 and line up with the registration assembly 140 in the optimal position for being advantageously oriented on the receiving conveying belt 125.

Adjustably attached to the side of the frame 110 at the upstream portion 121 of the receiving conveying section 120 is a registration assembly 140. The registration assembly 140 is suitably positioned parallel to the direction of the receiving conveying section 120. The registration assembly 140 comprises a media stop plate 144, media stop plate flange 145, and a media stop balls housing 147. Media stop plate 144 is adjustably mounted to the media stop plate support 148 and is preferably positioned in a plane parallel to the receiving conveying belt 125. The registration assembly 140 is a combination media stop and positioning apparatus that is adjustable in both the horizontal A direction and the vertical B direction to stop the movement of mailpieces. The mailpieces are shown generally as numeral 101, 101*a*, 101*b*, 101*c*, 101*d*, 101*e*, 101*f*, 101*g*, 101*x* and 101*z* and are depicted for illustration purposes but any number of mailpieces that comports with the design of the system could be used. The media stop plate 144 has a flange 145 extending upwardly in an acute angle over the receiving conveying belt 125 and continuing that acute angle downwardly from the media stop plate 144 to form the flange side 147*a* of the media stop balls housing 147. The media stop balls housing 147 extends from the first end 144*c* of the media stop plate 144 to the second end 144*d* of the media stop plate 144 and is attached to the bottom surface 144*g* of the media stop plate 144 at the flange end 144*e* of the media stop plate 144. The media stop balls housing 147 supports the suspended, freely rotating media stop balls 146. The freely rotating media stop balls 146 are between 0.25 to 1.25 inches in diameter and preferably 0.75 inches in diameter and made of steel. However, other size balls and materials could be used. Portions of the balls 146 extend below the housing 147. The media stop balls 146 are linearly positioned within the housing 147 and preferably spaced between approximately 1 and 2 inches apart and preferably 1.5 inches apart parallel to the direction of the receiving conveying belt 125 to align all sizes of mailpieces that are processed by the envelope printer 400. Other spacing of the balls can be used.

In the preferred embodiment, a driving means (FIG. 1) is housed in the receiving conveying section 120. In this case, a continuous drive motor 160 drives both the receiving conveying belts 125, and the stacking conveying belts 135, 136, 137, 138 through a mechanical drive mechanism. The driving means is preferably a motor 160 that drives an endless timing belt 161*b* mounted on a pair of timing pulleys 161*c*, 161*d*, which are mounted on a pair of shafts 161*a* and 162*a*. Shaft 161*a* is journaled for rotating the receiving conveying belt 125. Timing pulley 161*d* is housed at the upstream portion 131 of the stacking conveying section 130 and is sufficiently larger to provide speed reduction. Timing pulley 161*d* is cooperatively connected to timing pulley 162*c* by shaft 162*a*, with a significantly lower linear velocity of the stacking conveying belt 135, 136, 137, 138 than the receiving conveying belt 125. Endless timing belt 162*b* is mounted on the pair of timing pulleys 162*c* and 162*d* to drive shaft 163*a* at a reduced speed. However, the differential in the speed ratio between the receiving conveying belt 125 and the stacking conveying belt 135, 136, 137, 138 can be accomplished in any of the known ways. Ratio reduction, a different speed setting, or a photo optic interrupter can adjust surface speed.

Figure 3:
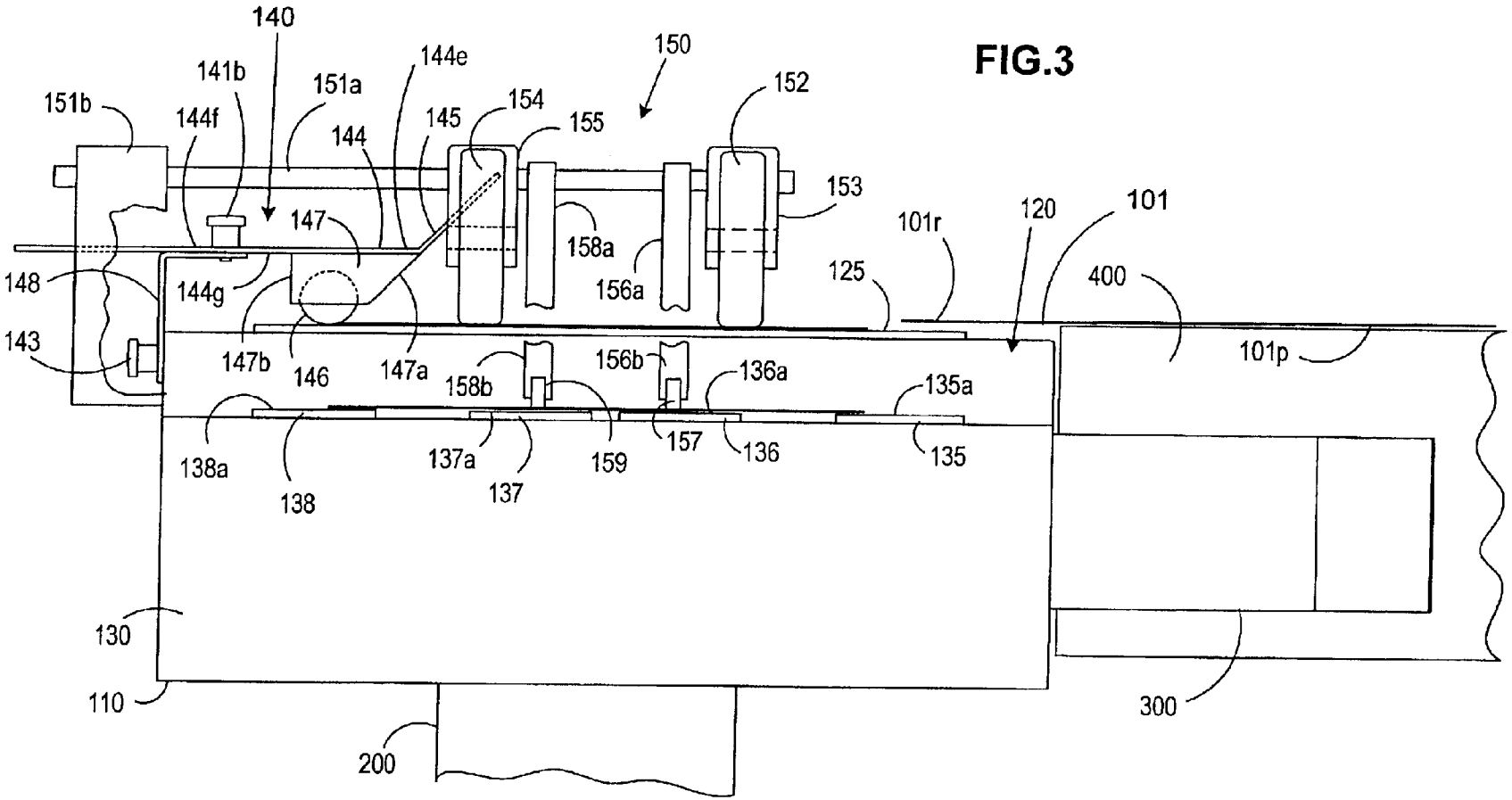
FIG. 3 is a downstream portion elevation view to show the relationship of the receiving conveying section and the stacking conveying section of the inventive stacking machine.

FIGS. 2 and 3 additionally illustrate a hold down assembly 150 that is attached to the side of the frame 110*a* at the downstream portion 122 of the receiving conveying section 120. Hold down assembly 150 has two or more hold down rollers 152, 154 and two or more hold down retainers 156, 158. The large hold down rollers 152, 154 contact and rotate with the receiving conveying belt 125 and are adjustably mounted to a media hold down assembly shaft 151*a*. The media hold down assembly shaft 151*a* extends in a plane parallel to the plane of the receiving conveyer belt 125 and extends perpendicular to the direction of travel of the receiving conveying belt 125 and over the belt 125. The shaft 151*a* is adjustably mounted to a hold down assembly bracket 151*b*, 151*c* that is fixedly mounted onto the side of frames 110*a* and 110*b*, respectively. The large hold down rollers 152, 154 are adjustable laterally. The hold down retainers 156, 158 are also adjustably mounted on the hold down assembly shaft 151*a* at hold down retainers end 156*a*, 158*a*, respectively, and are positioned above and make contact with the stacking conveying belts 136, 137 at the upstream portion 131 of the stacking conveying section 130 with the small hold down rollers 157, 159 that are rotatably mounted on hold down retainers 156, 158 at hold down retainer ends 156*b*, 158*b*, respectively. The hold down rollers 157, 159 are generally positioned closer to the downstream portion 122 of the receiving conveying section 120 for the stacking of thinner, slower moving mailpieces. In the case of faster moving mailpieces, the rollers 157, 159 is positioned farther away from the conveying section 120.

The stacking conveying section 130 having an upstream portion 131 and a downstream portion 132 is positioned at a lower height than the receiving conveying 120. The stacking conveying belts, 135, 136, 137, 138, have a top surface 135*a*, 136*a*, 137*a*, 138*a*, respectively, and extend above the stacking conveying section 130. The stacking conveying belts 135, 136, 137, 138 extend in direction X, from the upstream portion 131 to the downstream portion 132 of the stacking conveying section 130 and are positioned substantially at equal intervals in direction Y.

Figure 4:
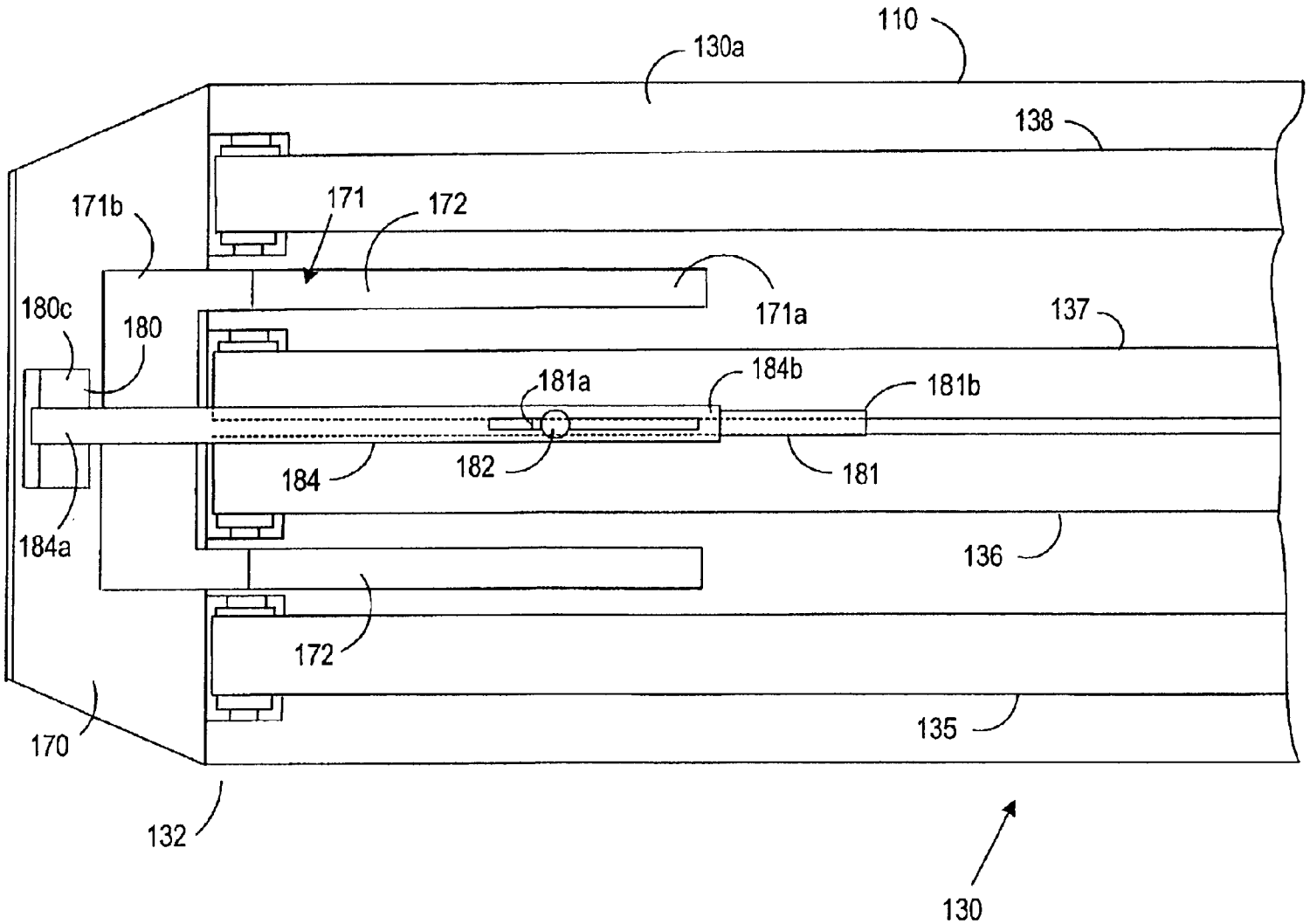
FIG. 4 is a plan view of the downstream portion of the stacking machine of the present invention.

FIG. 4 illustrates the angled stacking ramp 170 at the downstream portion 132 of the stacking conveying section 130. The stacking ramp 170 is disposed at a substantially upward angle relative to the plane of the stacking conveying section 130, preferably in the range of about 25° to 45°.

There is also a flexible angled stacking spring 171 having two ends: a first end 171*a* and a second end 171*b*. The first end 171*a* of the flexible angled stacking spring 171 is secured to the top surface 130*a* of the frame 110 at the downstream portion 132 of the stacking conveying section 130. The second end 171*b* extends toward and above the angled stacking ramp 170 and has an upward curvature that is springingly disposed above the angled stacking ramp 170.

Adjustably attached to the stacking ramp 170 is a stacker full arm fixture 180. The stacker full arm fixture 180 comprises a stacker full arm 184, an adjustable stacker full arm tip 181, a stacker full arm tip adjustment knob 182, and a stacker full arm fixture height adjustment knob 183. The stacker fill arm 184 has two ends: a stacker full arm end 184*a* pivotally attached to the stacker full arm fixture 180 on the stacking ramp 170, and stacker full arm end 184*b* extending parallel to the top surface 130*a* of the stacking conveying section 130 and towards the upstream portion 131 of the stacking conveying section 130 adjustably attached to the stacker full arm tip 181. The stacker full arm tip 181 has two ends: stacker full arm tip end 181*a* and stacker full arm tip end 181*b*.

A stacker full arm fixture tip end 181*b* is adjustably attached to the stacker full arm 184 to extend the stacker full arm 184 by decreasing the distance of the stacker full arm tip end 181*b* to the upstream portion 131 of the stacking conveying section 130, or to shorten the stacker full arm 184 by increasing the distance of the stacker full arm fixture tip end 181*b* to the upstream portion 131 of the stacking conveying section 130. The stacker full arm fixture tip 181 is adjustable by loosening the stacker full arm tip adjustment knob 182, and lengthening the distance or decreasing the distance from the tip 181 to the upstream portion 131 of the stacking conveying section 130. The knob 182 is loosened to lengthen the distance of the stack of mailpieces 101*z* or to shorten the distance of the stack 101*z* as it extends toward the upstream portion 131 of the stacking conveying section 130. The stacker full arm fixture tip 181*b* has a downward curve at the stacker full arm tip end 181 in which the distance from the top surface 130*a* of the conveyor section 130 to the tip end 181*b* is less than the distance of the stacker full arm tip end 181*a* to the surface 130*a* of the conveying section 130.

The stacker full arm fixture 180 is also adjustable in the vertical direction to support the top edges of the mailpieces that are being stacked. Additionally, the stacker full arm fixture 180 can be raised to accommodate the height of larger mailpieces, or lowered to accommodate the height of the smaller mailpieces by loosening the knob 183, adjusting the fixture 180 to the height of mailpieces standing on edge 101*n* and then tightening the knob 183. The height of the mailpieces at this point is the length of the mailpiece from long edge 101*m* to long edge 101*n*. The stacker full arm 184 is adjusted to the height of the mailpieces, standing on the long edge 101*n*, so that as the stack of mailpieces 101*z* advances toward the upstream portion 131 of the stacker 130, the mailpieces will contact the downward curve in the stacker full arm tip 181*b* and force the full arm fixture 184 upward.

There is a sensor 185 at the downstream portion 132 of the stacker full arm fixture 180 that detects upward movement of the stacker full arm fixture 184. When sensor 185 senses the upward movement of the stacker full arm fixture 184 (e.g., when the mailpieces have been stacked from the stacking ramp 170 towards the upstream portion 131 of the stacking conveying section 130 to force the stacker full arm 184 upwards), it causes the envelope feeder motor (not shown) to pause feeding mailpieces to the stacking machine 100 and stops the motor 160 which drives the conveying belts 125, 135, 136, 137, 138 on the stacking machine.

Figure 5:
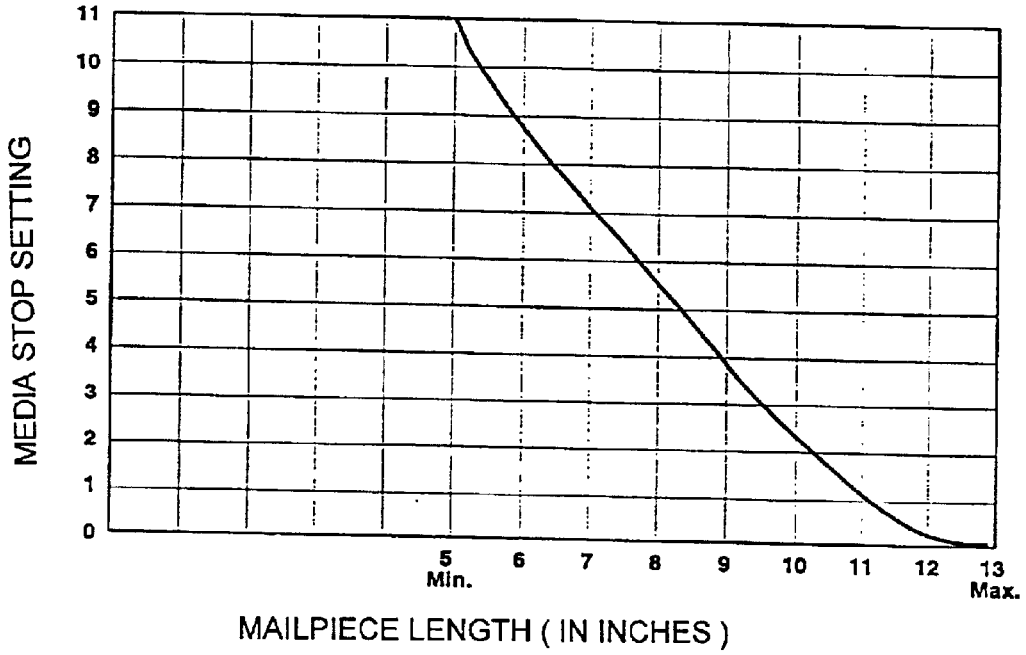
FIG. 5 is a chart showing the relationship of the mailpiece length and the registration assembly settings.

As illustrated in FIG. 5, the registration assembly 140 is adjustable in the horizontal direction A to decrease the distance from the envelope printer 400 to the media stop plate flange 145 on the registration assembly 140 to accommodate smaller mailpieces or to increase the distance from the mailpiece printer 400 to the media stop plate flange 145 as in the case of larger mailpieces. The media stop plate 144 is adjusted to the media stop setting on the horizontal adjustment scale 142 corresponding to the length of the mailpiece or the length of the material. The horizontal adjustment scale 142 is located on the top surface 144*f* of the media stop plate 144. Horizontal adjustment knobs 141*a* and 141*b* are loosened; the media stop plate 144 is extended to the number corresponding to the media stop setting according to the length of the mailpiece, and then the horizontal adjustment knobs 141*a* and 141*b* are tightened again.

Alternatively, the position of the registration assembly 140 with respect to the output passageway of the envelope printer 400 can also be set by aligning the leading edge 101*s* of the mailpiece 101*b* with the media stop balls 146 and moving the registration assembly 140 until it contacted the lead edge 101*s* of the mailpiece 101*b* after the mailpiece 101*b* had entirely exited the envelope printer 400 and fully dropped onto the receiving conveying belt 125. The registration assembly 140 is adjusted to optimally accommodate both large and small envelopes. The positioning of the assembly 140 in the horizontal direction A away from the printer 400 enables the larger mailpieces 101 to be properly positioned on the receiving conveying belt 125 when the mailpieces 101 ejected from the mail processing machine contact the flange 145. When the assembly 140 is positioned closer to the printer 400, smaller mailpieces are properly positioned on the receiving conveying belt 125. Smaller mailpieces are generally less than ⅛ inch thick. Proper positioning of mailpieces 101 is to have the mailpiece 101 lying flat on the conveying belt 125, completely exited from the envelope printer 400.

The registration assembly 140 has vertical adjustment knob 143 that secures the media stop plate support 148 to the side of the frame 101*a*. For stability purposes, two or more vertical adjustment knobs are preferable. The assembly 140 is adjusted vertically to allow the balls 146 to extend beyond the media stop plate 144 to enable the balls 146 to contact and freely rotate over the receiving conveying belt 125 or to contact a mailpiece leading edge 101*s* that is on the receiving conveying belt 125. The vertical adjustment knob 143 located on the side of the frame 101*a* is loosened. The registration assembly 140 is raised or lowered according to optimal settings determined by the thickness of the mailpieces so that the media stop plate 144 is at a distance to enable the mailpiece to drop onto the receiving conveying belt 125. For mailpieces that are less than ⅛ inch thickness, the registration assembly 140 is set at a height sufficient for the balls 146 to be at the first point of contact. For mailpieces that are greater than ⅛ inch thickness, the registration assembly 140 is set at a height sufficiently low enough to prevent mailpieces from getting below the edge of the registration assembly 140.

Figure 6:
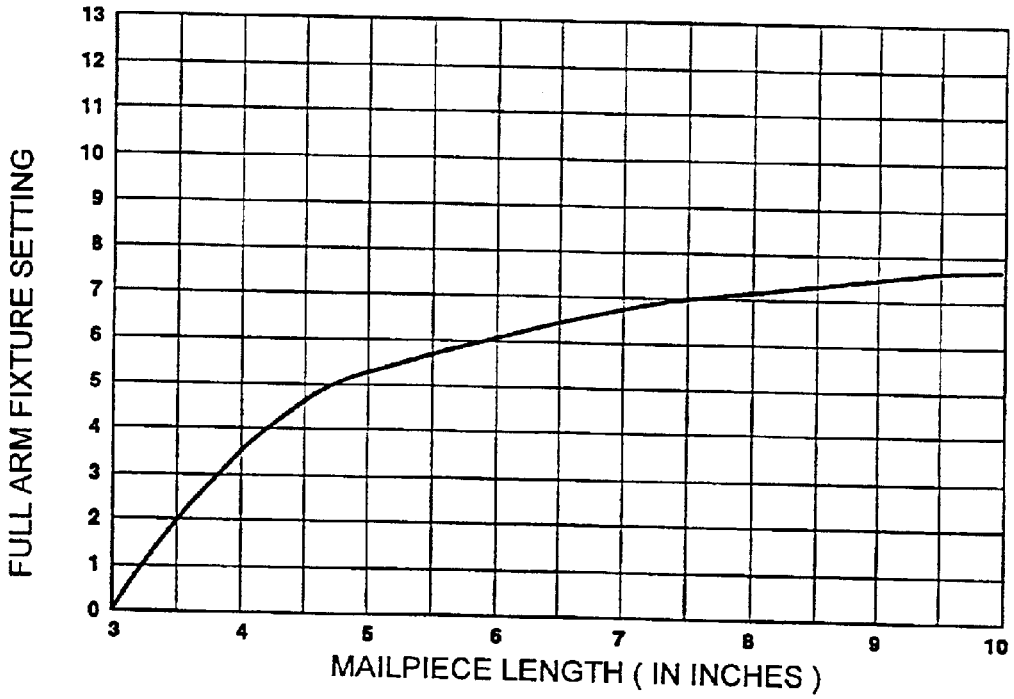
FIG. 6 is a chart showing the relationship of the mailpiece length and the stacker full arm fixture settings.

FIG. 6 is a chart depicting the settings of the full arm fixture 180. The length of the mailpiece from the leading long edge 101*m* to trailing long edge 101*n* determines the optimal settings from the full arm fixture. The stacker full arm fixture height adjustment knob 183, when loosened, allows the stacker full arm fixture 180 to be raised or lowered, thereby either increasing the distance between the length of the stacker full arm 184 and the top surface 130*a* of the stacking conveying section 130 or by decreasing the distance between the length of the stacker full arm 184 and the top surface 130*a* of the stacking conveying section 130, respectively.

The speed of the receiving conveying belt 125 can be adjusted by a speed adjustment control (not shown) to accommodate the different speeds and sizes of mailpieces 101 that are ejected from the envelope printer 400. The speed of the receiving conveyor belt 125 is adjusted to maintain the proper amount of spacing between mailpieces 101. When the speed adjustment control is used to increase the speed of the receiving conveying belt 125, the speed of the stacking conveying belts 135, 136, 137, 138 is also increased at the same surface speed differential that exists between the receiving conveying belt 125 and the stacking conveying belts 135, 136, 137, 138. Likewise, when the speed adjustment control is used to decrease the speed of the receiving conveying belt 125, the speed of the stacking conveying belts 135, 136, 137, 138 is also decreased at the same surface speed differential that exists between the receiving conveying belt 125 and the stacking conveying belt 135, 136, 137, 138. The speed of the receiving conveyor belt 125 is set to enable a gap or a space to exist between consecutive mailpieces 101 that have been deflected onto the receiving conveying belt 125. One of ordinary skill in the art can set the speed of the stacking machine 100 conveying belt 125 to create the appropriate gap between mailpieces 101 for consecutively depositing and subsequently overlapping the mailpieces 101.

Referring to FIG. 1, the stacking machine 100 is shown supported by the stacker stand 200. The height h of the distance of the stacking machine 100 is optimally adjusted to a height that generally aligns the stacking machine 100 with the output of the envelope printer 400 or other machine and accommodates different mailpieces 101. The height of the stacker stand 200 is adjusted by loosening the adjustment knob 210, securely raising or lowering stacking machine 100 to an optimal height and tightening the adjustment knob 210 on stacker stand 200. The inventive stacking machine 100, however, can be supported by another surface or stand and is not limited to use with this stand.

In addition to the stacker full arm fixture 180 pausing the printer 400 and the stacking machine 100, there can also be a switch enabling a manual or an automatic mode of operation. The automatic mode enables the receiving conveying belt 125 and the stacking conveying belts 135, 136, 137, 138 to transport mailpieces as long as the envelope printer 400 is ejecting mail pieces. When the stack of mailpieces 100*z* has reached the stacker full arm tip end 181*b*, causing the stacker full arm 184 to be raised, the envelope printer 400 is stopped. If the switch is in a manual mode of operation, the stacking machine 100 runs constantly, independent of the envelope printer 400. Additionally, there can be a switch that will stop the stacking machine 100 when mailpieces jam. After the jam is cleared, the switch resets the stacking machine 100 for operation.

Figure 7:
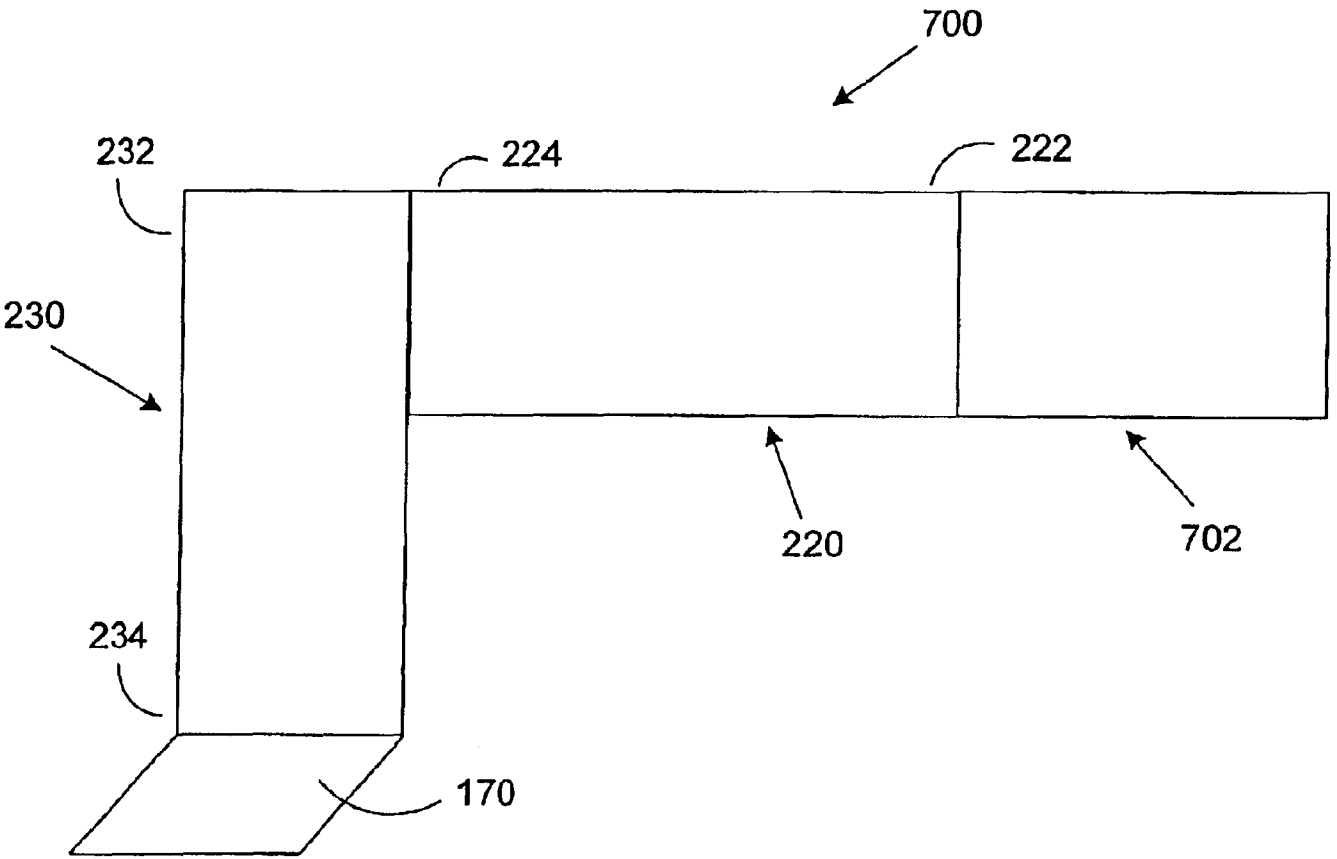
FIG. 7 is a schematic view of the inventive stacking machine illustrating an alternate configuration in which the mailpiece processing machine is positioned in line with the stacking machine.

An alternative embodiment as illustrated in the schematic in FIG. 7 includes a stacking device 700 in line with a mail-processing machine 702. The stacking machine 700 has two conveying sections positioned orthogonally. The mail processing machine 702 is positioned in line to the first, receiving conveying section 220 at the upstream end 222 of the receiving conveying section 220 and orthogonally connected at the downstream portion 224 to the upstream portion 232 of a stacking section 230. At the downstream portion 234 of the stacking conveying section is an angled stacking ramp 170 for stacking mailpieces in consecutive order.

Mailpiece Transport

In describing the preferred embodiment of the present invention in relation to the handling of envelopes, reference is made to FIGS. 1–2. Mailpiece 101 has four edges, a leading long edge 101*m*, a trailing long edge 101*n*, a leading short edge 101*s*, and a trailing short edge 101*t*.

The inventive stacking machine 100 is positioned at a right angle to the envelope printer 400 to accommodate mailpiece 101 being delivered thereto. This allows mailpieces 101 to exit the mailpiece printer 400 with a leading short edge 101*s* of the mailpiece with the printed side of the envelope on top. The receiving conveying belt 125 receives the first mailpiece 101*b* from the envelope printer 400 in the Y direction with the short edge 101*s* leading. The registration assembly 140 stops the mailpiece from traveling in the direction Y as it exits the printer 400 and allows the mailpiece 101 to drop onto the receiving conveying belt 125 that is traveling in the direction X.

Larger mailpieces ejected from the mailpiece printer 400 will pass over the receiving conveying belt 125, contact the media stop plate flange 145, drop onto the receiving conveying belt 125 and get transported toward the downstream portion 122 of the receiving conveying section 120. When a larger mailpiece is ejected onto the receiving conveying belt 125, the registration assembly 140 must be positioned at a distance farther away from the mailpiece printer 400 to allow the entire envelope to drop onto the receiving conveying belt 125. Due to the weight and the forces of the larger mailpieces, the mailpieces contact the media stop flange 145, with the short edge 101*s* first, and will then be positioned with the long edge 101*m* first with a limited amount of skew on the fast moving receiving conveying belt 125. This allows the mailpieces to be transported with the leading long edge 101*m* first, a direction orthogonal to the envelope printer 400. The registration assembly 140 assists in stopping the mailpiece 101 and aligning the short edge 101*s* of the mailpiece 101 to be transported on the receiving conveying belt 125 with minimum contact to the mailpiece 101 while maintaining the printed side of the mailpiece 101 up.

When smaller, lightweight mailpieces are transported, however, the edge 101*s* of the mailpiece 101*b* is trapped between the balls 146 and the fast moving receiving conveying belt 125 and the edge 101*s* of the mailpiece 101*b* is brought into alignment. The mailpiece is brought into alignment by the forces resulting from the friction of the moving receiving conveying belt 125 on the bottom side 101*p* of the mailpiece 101 which contacts the receiving conveying belt 125 along with the media stop balls 146 on the printed top side of the mailpiece 101*r*. Smaller mailpieces are generally less than ⅛ inch thick and generally require a surface upon which to contact for assistance for an even registration of the mailpiece. Specifically with smaller mailpieces, the lack of weight and size contribute to the mailpiece 101 assuming a skewed position on the fast moving receiving conveying belt 125. The combination of the flange 145 and the media stop balls 146 on the assembly 140, however, will help position the mailpiece 101*b* on the receiving conveying belt 125 with the least amount of skew. Therefore, the ejected mailpiece 101 from the output passageway 410 of the printer 400 will contact the flange 145 and drop onto the fast moving receiving conveying belt 125, and the edge 101*s* will get trapped between the balls 146 and the fast moving conveying belt 125. Since the freely rotating balls 146 are linearly positioned equidistant from each other in the direction X, the same direction in which the receiving conveying belt 125 is moving, and, the balls 146 are contained within the media stop balls housing 147, the edge 101*s* of the mailpiece 101*b* will align and then be transported in the downstream direction x until the mailpiece 101*c* is moving out of contact from the registration assembly 140 as is seen in FIG. 2. The forces created by the combination of the top of the edge 101*s* of the mailpiece 101*b* being held by the balls 146 as the receiving conveying 125 is moving below the mailpiece 101*b* help register the edge 101*s* of the mailpiece 101. The limited vertical force exerted on the mailpiece 101*b* and 101*c* by the weight of the balls 146 in the downward direction provide sufficient force to trap the mailpiece 101*b* and assist in registering the edge 101*s* of the mailpiece as the mailpiece 101*b* makes an orthogonal change in direction.

There is a minimum amount of contact with the mailpiece to orient the mailpiece 101 in an advantageous aspect ratio, long edge 101*n* at the base to be transported on the receiving conveying belt 125. The printed mailpiece 101 may have been printed with ink that has not dried as the mailpiece 101 passes through the output passageway 410 of the envelope printer 400. Thus, the mailpiece 101 is transported without contacting the printed areas on the mailpiece 101.

The following mailpieces continue with the same pattern as above. The mailpieces are deposited onto the receiving conveying belt 125 with a gap between consecutive mailpieces, as is shown by mailpiece 101*c* and 101*b*.

The mailpiece 101 is transported on the receiving conveyor belt 125 to the hold down assembly 150. The mailpiece 101 is registered again at the leading edge 101*m* at the hold down assembly 150 without contacting the printed areas on the mailpieces 101. The mailpiece is transported, printed side up, long edge 101*m* leading, to the hold down assembly 150. The mailpiece 101 is aligned by the receiving conveying hold down rollers 152, 154 adjustably mounted to the hold down assembly shaft 151*a* at long edge 101*m*. The mailpiece 101*e* is then transported under the fixed hold down rollers 152, 154 with normal force. The large hold down rollers 152, 154 are adjustably mounted to a media hold down assembly shaft 151*a* and provide alignment of the mailpiece 101 when the leading edge 101*m* of the mailpiece 101 is caught in the nip of the normal force rollers 152, 154 when the mailpiece 101 is on the moving receiving conveyor belt 125. Additionally, the hold down rollers 152, 154 provide drive and control of the mailpiece 101*e* and 101*f* as it transitions from the receiving conveying belt 135 to the stacking conveying belts 135, 136, 137, 138. The rollers 152, 154 are preferably positioned in such a way that they retain the mailpiece 101*e* but do not come into contact with the printed area on the mailpiece, specifically, the address zones. If the rollers 152, 154 are positioned to contact the printed address zone, the rollers 152, 154 could cause smudging of the printed area if the ink is not dry. Therefore, the hold down rollers 152, 154 are adjustably mounted on a media hold down assembly shaft 151*a*. The hold down retainers 156, 158 are also adjustably mounted on the hold down assembly shaft 151*a* and control the mailpiece 101*f* as it lands on the stacking conveying belts 135, 136, 137, 138. The hold down retainers 156, 158 are generally positioned closer to the downstream portion 122 of the receiving conveying section 120 for the stacking of thinner, slower moving mailpieces. In the case of faster moving mailpieces, the retainers 156, 158 are positioned farther away from the conveying section. Therefore, the mailpieces 101 are transported under the fixed hold down rollers, 152, 154, drop down onto the stacking conveying belts 135, 136, 137, 138 and are guided with sufficient normal force by the hold down retainers 156, 158 to be transported under the small hold down rollers 157, 159.

Next, the mailpiece 101*f* is guided down onto the stacking conveying belts 135, 136, 137, 138 with the hold down retainers 156, 158 and under the small hold down rollers 157, 159 onto the stacking conveying belts 135, 136, 137, 138. The stacking conveying belts 135, 136, 137, 138 transport the mailpieces at a slower speed than the speed than the receiving conveying belt 125, and enable the positioning of the leading edge 101*m* of the mailpiece 101*e* to overlap the trailing edge of the previous mailpiece 101*f*.

As discussed previously, the linear speed or the surface speed of the stacking conveying belts 135, 136, 137, and 138 is slower than the linear speed or the surface speed of the single wide receiving conveying belt 125. This causes the leading edges 101*m* of the following mailpieces to drop flat onto the trailing edges 101*n* of the previous mailpieces 101. The ratio of the speed of the receiving conveying belt 125 and the stacking conveying belt 135 is approximately 4:1. Therefore, as soon as the trailing edge 101*n* of a mailpiece 101 exits the hold down rollers 152, 154, the mailpiece 101*f* decreases in speed to the linear speed of the stacking conveying belt 135. Additionally, the height of the stacking conveying section 130 is lower than the height of the receiving conveying section 120. The following mailpieces 101 are guided onto the trailing edges 101*n* of the mailpieces 101 on the stacking conveying belt 135 in a shingled overlapped order. As the mailpiece 101 is transported on the stacking conveying belt 135, part of the mailpiece 101 will advance allowing a portion of the long edge 101*m* leading to advance while the following mailpiece 101 is deposited onto the trailing edge 101*n* of the mailpiece.

With the reduction in speed from the receiving conveying belt 125 to the stacking conveying belts 135, 136, 137 and 138, along with the drop of the mailpiece from a higher, receiving conveying section 120 to the lower, stacking conveying section 130, the mailpieces 101 continue to position themselves consecutively with the leading edge 101*m* of the mailpiece covering the trailing edge 101*n* of the previous mailpiece in a shingled manner. The surface speed differential between the receiving conveying belt 125 and the stacking conveying belts 135, 136, 137, and 138 enables the mailpieces 101 to always shingle in consecutive order. The mailpieces 101 are thus transported along the stacking conveying 130 towards the downstream portion 132. Also, since there is a gap between the mailpieces while on the receiving conveying belt, and the mailpiece 101 is horizontally positioned with the printed side up, the ink on the mailpieces can dry before the mailpieces are put on the stacking conveying belts 135, 136, 137, 138 in a shingled order. Another approach is to have a variable speed setting in which another motor with its own speed control is used. Another alternative would be to use a photo optical controlled motor or clutch which would turn the stacking conveying belts 135, 136, 137, 138 off once the lead piece of mail uncovers it.

The mailpieces are transported to the stacking ramp 170. The stacking conveying belts 135, 136, 137, and 138 transport mailpieces 101*z* downstream to the angled stacking ramp 170 whereby the leading edges 101*m* of the mailpieces are transported to the stacking location pivoted upwardly. The function of the stacking ramp 170 is to intercept the leading edges 101*m* of the mailpieces as they are transported through the stacking location and cause the mail pieces to pivot upwardly onto the edge 101*n*. In addition to the stacking ramp 170, flexible angled stacking spring 171, is secured to the top surface 130*a* of the frame 110 of the stacking conveying section 130 at the downstream portion 132 and has a slight upwards curvature springingly disposed above the angled stacking ramp 170. The purpose of this is to increase the angle at which mail pieces 101*z* must be pivoted to be stacked to accommodate smaller mailpieces. The smaller mailpieces will be upwardly pivoted and supported against the flexible angled stacking spring 171 to properly support smaller mailpieces. For larger mailpieces, the weight of the thicker, heavier mailpieces will cause the flexible angled stacking spring 171 to be depressed as the mailpieces accumulate.

The mailpieces 101 ultimately are stacked against the upwardly angled stacking ramp 170 at the downstream portion 132 of the stacking conveying section 130 in a direction orthogonal to the ejection path of the envelope printer 400. Again referring to FIG. 2, mailpiece 101*x* is first stopped against the angled surface of the stacking ramp 170 followed by the succeeding mailpieces to form a stack of mailpieces 100*z*. This enables the operator to face the stacking ramp 170 and the addresses and inimical of each mailpiece 101 that falls onto the stacking conveying belt 135, 136, 137, 138 is clearly visible. The stack of mailpieces 101*z* will continue extending toward the upstream portion 131 of the stacking conveying section 130. The stacker full arm 184 supports the upper long edges 101*m* of the mailpieces as the mailpieces accumulate. The mailpiece 101 at the stacker ramp 170 approaches the position of standing on the long edge 101*n* with the leading edge 101*m* as the top of the mailpiece 101. When the stack of mailpieces has reached the downward curve in the stacker full arm tip end 181*b*, the stacker full arm 184 is forced upward. The upward movement of the full arm 184 causes the stacking machine 100 motor to idle and the printer 400 to pause. The stack of mailpieces 100*z* can be removed from the stacking machine 100, and the consecutive order of the mailpieces that had been ejected from the envelope printer 400 remains in order. After the stack of mailpieces 100*z* has been removed, the printer is activated, and the entire stacking machine will be operational. This also enables the consecutive order of the mailpieces to remain intact.

While the preferred embodiment of the invention has been described and illustrated above, it should be understood that these are exemplary of the invention and are not considered to be limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. An apparatus for stacking mailpieces received from an output device in consecutive order, the apparatus comprising:

a. a frame;

b. a plurality of conveying sections, the plurality of conveying sections comprising a receiving conveying section having an upstream portion and a downstream portion and a stacking conveying section having an upstream portion and a downstream portion, the receiving conveying section is positioned at a first height and in line with the exit from a mail processing machine at the upstream portion and orthogonal to the stacking conveying section at the downstream portion, the stacking conveying section is at a second height, the first height is greater than the second height;

c. a ramp extending from the downstream portion of the stacking conveying section;

d. a first continuous belt extending along the receiving conveying section in a first direction and positioned centrally along a second direction of the receiving conveying section, and having a top surface that extends above the receiving conveying section and which contacts the mailpieces;

e. a second continuous belt extending along the stacking conveying section in the second direction and positioned along the first direction of the stacking conveying section, the second continuous belt having a top surface which extends above the stacking conveying section and which contacts the mailpieces received from the mail processing machine;

f. means for driving the first continuous belt at a first speed on the receiving conveying section and for driving the second continuous belt at a second speed on the stacking conveying section, the second speed of the second continuous belt is slower than the first speed of the first continuous belt on the receiving conveying section; and, g. a positioning and guiding means positioned at the downstream portion of the receiving conveying section, the positioning and guiding down means comprising normal force rollers that contact the receiving conveying belt to align the mailpieces at the receiving conveying section and guide, the mailpieces onto the stacking conveying belt.

2. A method of stacking mailpieces received from a mail processing device, wherein the mailpiece has a long leading edge, a long trailing edge, a short leading edge and a short trailing edge, said method comprising the steps of:

a. receiving a first mailpiece from the mail processing device in a second direction with the short leading edge leading;

b. deflecting the first mailpiece onto a moving conveying belt with the long leading edge leading, the moving conveying belt is moving in a first direction, the first direction is at a right angle to the second direction;

c. receiving a second mailpiece from the mail processing device in the second direction with the short leading edge leading;

d. deflecting the second mailpiece onto the moving conveying belt with the long leading edge leading while the conveying belt is moving in a first direction, the first direction is orthogonal to the second direction;

e. continuing the movement of the first mailpiece on the moving conveying belt under an adjustable hold down assembly, the hold down assembly comprising a plurality of normal force roller;

f. moving the first mailpiece from the conveying belt traveling at a first speed and positioned at a first height to a stacking conveying belt travelling at a second speed and positioned at a second height, the first speed is faster than the second speed, the first height is higher than the second height;

g. guiding the second mailpiece onto a long trailing edge of the first mailpiece; and h. continuing the movement of the mailpiece toward a vertically sloped stacking ramp until the first mailpiece interfaces with the sloped stacking ramp.

3. An apparatus for stacking mailpieces received from a mail-processing machine in consecutive order, the apparatus comprising:

a. a frame;

b. a plurality of conveying sections, the plurality of conveying sections comprising a receiving conveying section having an upstream portion and a downstream portion and a stacking conveying section having an upstream portion arid a downstream portion, the receiving conveying section is positioned at a first height at a right angle to the output passageway of the mail processing machine at the receiving conveying section upstream portion and in line and with the stacking conveying section at the stacking conveying section downstream portion, wherein the stacking conveying section is at a second height, the first height is greater than the second height;

c. a ramp extending from the downstream portion of the stacking conveying section;

d. a first continuous belt extending along the receiving conveying section in a first direction positioned centrally along a second direction of the conveying section, the continuous belt having a top surface that extends above the receiving conveying section and that contacts the mailpieces received from the mall processing machine;

e. a plurality of second continuous belts extending along the stacking conveying section in the first direction and positioned substantially at equal intervals extending along the second direction of the stacking conveying section, the plurality of second continuous belts having a top surface that extends above the stacking conveying section and which contact the mailpieces received from the receiving conveying section;

f. means for driving the first continuous belt at a first speed on the receiving conveying section in the first direction and for driving the plurality of second continuous belts at a second speed on the stacking conveying section in the first direction, the second speed of the plurality of belts is less than the first speed of the first continuous belt on the receiving conveying section;

g. an assembly for positioning the mailpieces received from the mail processing machine on the single continuous belt of the receiving conveying section adjustably mounted to the frame at the upstream portion of the receiving conveying section, wherein the receiving convoying section is located between the assembly and the mail-processing machine:

1. the assembly for positioning a mailpiece is an adjustable media stop plate positioned above the surface of the receiving conveying section having a flange extending at an acute angle over the first continuous belt of the receiving conveying section, the media stop plate is adjustably mounted to accommodate the receiving of different size mailpieces from the mail processing machine;

2. the assembly for positioning mailpieces has a housing positioned on the underside of the adjustable media stop plate with a plurality of freely rotating bails positioned linearly in a direction parallel to the first direction; and 3. the adjustable media stop plate is adjustable in a plurality of direction, the plurality of directions comprise a vertical direction and a horizontal direction; and, h. a means for positioning and guiding mailpieces connected to the frame at the downstream portion of the receiving conveying section, the means for positioning comprising normal force rollers that contact the receiving conveying belt to align the mailpieces at the receiving conveying section and guide the mailpieces onto the stacking conveying belt.

4. The apparatus as described in claim 3, wherein the ramp is an angled stacking ramp positioned to support a stack of mailpieces.

5. The apparatus as described in claim 4, wherein the angled stacking ramp has an angle, wherein the angle ranges from 25 to 45 degrees.

6. The apparatus as described in claim 4, wherein the angled stacking ramp has a flexible angled stacking spring, the flexible angled stacking spring having a first end and a second end, the first end being securely fastened to an upper surface of the frame and the second end extends in the downstream direction above the angled stacking ramp.

7. The apparatus as described in claim 3, wherein the ramp includes a stacker full arm, the stacker full arm adjustably mounted to the ramp and extending parallel to a height of the mailpieces extending towards the upstream portion of the stacking conveying section, the stacker full arm providing support at a top edge of the mailpieces.

8. An apparatus for stacking mailpieces as described in claim 3, wherein the means for positioning and guiding mailpieces comprises a plurality of laterally adjustably mounted rollers on a shaft, said shaft extends in a plane parallel to the first continuous belt wherein said shaft is positioned perpendicular to said first direction.

9. An apparatus for stacking mailpieces as described in claim 8, wherein the means for positioning and guiding mailpieces comprises a plurality of retainers, said retainers guide mailpieces from said first continuous belt at said first height to said plurality of second continuous belts at said second height.

10. An apparatus for stacking mailpieces as described in claim 9, wherein the means for positioning and guiding mailpieces, comprises a guiding means having a first end and a second end, the guiding means being adjustably mounted to a shaft at the first end, the guiding means in contact with the plurality of second continuous belts at the second end, wherein the second end is at the upstream portion of the stacking conveying section.

11. An apparatus for stacking mailpieces as described in claim 10, wherein the means for positioning and guiding mailpieces comprises a plurality of rollers rotatably mounted on the second end of the guide means.

* * * * *